US005375282A

United States Patent [19]

Dausch et al.

[11] Patent Number: 5,375,282

[45] Date of Patent: Dec. 27, 1994

[54] SYSTEM AND METHOD FOR DETECTING AND INTERRUPTING AN OUT-OF-BALANCE CONDITION IN A WASHING MACHINE

[75] Inventors: Mark E. Dausch, Latham; Vivek V. Badami, Schenectady; Donald T. McGrath, Scotia; Walter Whipple, III, Amsterdam, all of N.Y.

[73] Assignee: General Electric Company, Schenectady, N.Y.

[21] Appl. No.: 124,517

[22] Filed: Sep. 20, 1993

[51] Int. Cl.[5] ..... D06F 37/24

[52] U.S. Cl. ..... 8/159; 68/12.06; 68/12.26; 68/23.3; 210/144

[58] Field of Search ..... 8/159; 68/12.06, 12.26, 68/23.1, 23.3; 494/82; 292/DIG. 69; 192/136; 210/144, 739; 248/638

[56] References Cited

U.S. PATENT DOCUMENTS

| | | | |
|---|---|---|---|
| 3,088,593 | 5/1963 | Stilwell, Jr. | 68/12.06 X |
| 3,145,818 | 8/1964 | Stelli | 192/136 |
| 3,149,212 | 9/1964 | Smith | 200/61.7 |
| 3,227,835 | 1/1966 | Conrath | 200/61.45 |
| 3,298,525 | 1/1967 | Houser | 210/144 |
| 3,318,118 | 5/1967 | Ohlson | 68/23.1 |
| 3,447,686 | 6/1969 | Houser | 68/23.1 X |
| 3,504,777 | 4/1970 | Waugh | 192/136 |
| 3,736,772 | 6/1973 | Baker | 68/12 R |
| 4,098,098 | 7/1978 | Altnau | 68/23 R |
| 4,449,383 | 5/1984 | Cartier | 68/12 R |
| 4,910,502 | 3/1990 | Serveau et al. | 340/683 |
| 5,050,407 | 9/1991 | Wild | 68/12.06 |

*Primary Examiner*—Philip R. Coe

*Attorney, Agent, or Firm*—Enrique J. Mora; Paul R. Webb, II

[57] ABSTRACT

A system and method are provided for detecting and interrupting an out-of-balance (OOB) condition in a washing machine. The system includes pneumatic generating units for generating a predetermined fluidic pressure in response to excursions of a tub of the washing machine during a spin cycle; an actuator which is fluidly coupled to such generating units for providing an actuating position corresponding to the OOB condition; and a switch responsive to the actuator in its actuating position to deenergize a motor which spins the basket for holding the articles to be cleansed and thereby interrupt the OOB condition.

44 Claims, 4 Drawing Sheets

SYSTEM AND METHOD FOR DETECTING AND INTERRUPTING AN OUT-OF-BALANCE CONDITION IN A WASHING MACHINE

RELATED APPLICATIONS AND PATENTS

This application is related to the application entitled "Out-of-Balance Condition Detecting System With Lid Actuated Switching Assembly", Ser. No. 081124,519, (RD-23057) filed concurrently with this application and assigned to the assignee of the present invention, and which is incorporated herein by reference.

BACKGROUND OF THE INVENTION

The present invention is generally related to washing machines and, more particularly, to a system and method for detecting and interrupting an out-of-balance (OOB) condition which can arise during the operation of the washing machine.

In a typical washing machine (such as a top or front-loading washing machine) the OOB condition can actually occur during a spin cycle, for example, when the articles to be cleansed, such as clothing and the like, bunch up asymmetrically at various locations in the basket for holding such articles. For various detrimental reasons the OOB condition is not desirable if left uninterrupted. For example, a tub which encloses the basket may violently strike the cabinet of the washing machine and thus cause damage either to the tub, the cabinet or both. Further, unacceptable stress forces can develop during the OOB condition that can affect the suspension mechanism of the washing machine as well as other components thereof such as the transmission or other suitable connecting device which links the motor of the washing machine to the spinning basket.

Some existing electromechanically controlled washing machines incorporate an OOB switch or combination of a lid and OOB switch which in either case deenergize the motor of the washing machine during high speed spin if the lateral excursion of the outer tub reaches a point where the tub mechanically trips the OOB switch. A drawback of this approach is that a single lateral excursion of the outer tub is sufficient to trip the OOB switch. This is not desirable because the operation of the washing machine can be mistakenly interrupted during situations which do not correspond to an actual OOB condition (i.e., a detrimental or harmful OOB condition), and thus the time required to complete the washing operation increases unnecessarily. For example, as the basket gradually increases its spin speed from a no spin state up to its specified operating spin speed, it is typical to encounter certain natural mechanical frequencies which can induce brief or momentary excursions of the tub. However, such brief or momentary excursions which do not correspond to the actual OOB condition can be sufficient to trip the OOB switch and thus this approach is prone to error being that a single excursion of the tub is all that is required to mechanically trip the OOB switch.

Other washing machines which incorporate a respective microprocessor to provide electronic control of the washing operation can detect the OOB condition and take suitable corrective action to interrupt the OOB condition. However, the OOB detection technique utilized in this approach is implemented through the use of elaborate logic which cooperates with the controlling microprocessor or other such electronic device to detect the OOB condition and thus implementation of this technique which requires use of such elaborate logic adds to the complexity as well as to the cost of the washing machine.

It is therefore an object of the present invention to provide an improved system and method for detecting and interrupting an OOB condition in a washing machine which is not subject to the foregoing disadvantages of existing OOB switches.

It is another object of the present invention to provide a system and method for detecting and interrupting an OOB condition which can be conveniently used either in electronically or electromechanically controlled washing machines.

It is yet another object of the present invention to provide a system and method which does not require elaborate logic to detect and interrupt an OOB condition.

SUMMARY OF THE INVENTION

The foregoing and further objects of the present invention will become apparent as the description proceeds. In accordance with the present invention, a system and method are provided for detecting and interrupting an out-of-balance condition in a washing machine which typically includes a washer basket that spins about a predetermined spin axis during a spin cycle. The OOB condition can be characterized by excursions during a spin cycle of a tub which encloses the washer basket. The tub excursions can be in a direction generally perpendicular to the spin axis of the washer basket, for example. The system comprises means for generating a predetermined fluidic pressure in response to excursions of the tub. The generating means can be constituted of one generating unit comprising a respective housing and a generating piston reciprocating relative to one another to produce the fluidic pressure, an example of a fluid that can be conveniently used to develop such fluidic pressure is air. Additional generating units together with the one generating unit can be arranged in respective mutually spaced pairs oriented by way of example and not of limitation at a predetermined angle (such as about 90° or other suitable angle) with respect to one another in a respective substantially perpendicular plane relative to the spin axis of the washer basket positioned in the tub of the washing machine. Alternatively, the generating means can be constituted of one or more bellows which cooperate to produce the fluidic pressure.

In either case, an actuator is fluidly coupled to the generating means and the actuator is responsive to a predetermined level of fluidic pressure for providing an actuating position corresponding to the out-of-balance condition. The actuator comprises a respective enclosure supported in the cabinet of the washing machine, the actuator further comprises biasing means and an actuating piston which cooperate in their respective enclosure such that the actuating piston moves in response to the predetermined level of fluidic pressure from a nonactuating position to reach the actuating position and back to the nonactuating position absent the predetermined level of fluidic pressure upon interruption of the out-of-balance-condition.

A switch is responsive to the actuator in its actuating position to deenergize a motor which spins the basket for holding articles to be cleansed in the washing machine. The switch can be a magnetically actuated switch such as a magnetic reed switch, for example, which responds to the magnetic field produced by a magnet which may be situated in one face of the actuating piston. Alternatively, the actuating piston may be constituted of magnetic material. In this mariner, a washing machine can be provided with the foregoing system for detecting and interrupting the out-of-balance condition which may arise during operation of the washing machine.

A method in accordance with the present invention for detecting and interrupting an out-of-balance condition in a washing machine comprises generating a fluidic pressure in response to excursions of the tub; operating an actuator to be responsive to the fluidic pressure; and deenergizing the motor of the washing machine when the actuator is in its actuating position.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following detailed description in conjunction with the accompanying drawings in which like numerals represent like pans throughout the drawings, and in which:

DETAILED DESCRIPTION OF THE INVENTION

Figure 1:
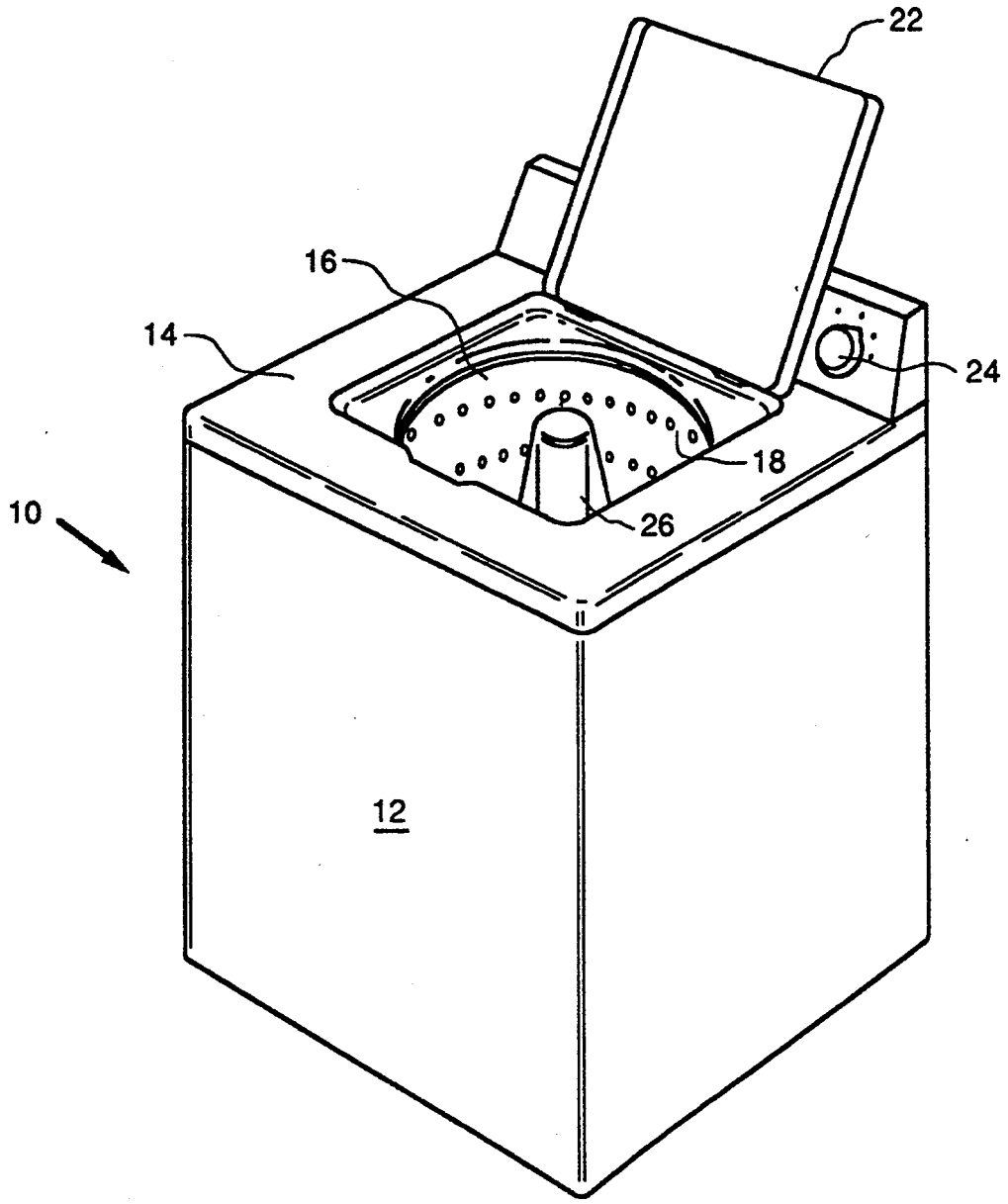
FIG. 1 is a perspective view of a typical top-loading washing machine.

FIG. 1 illustrates a top loading washing machine 10 which has a cabinet 12 having a respective top panel 14 with an access opening 16 for loading and unloading articles to be cleansed in a washer basket 18. In a conventional washing operation, the articles to be cleansed are loaded through access opening 16 into basket 18, and after lid 22 is closed and a control knob 24 or other suitable control device is properly set, the washing machine sequences trough a predetermined sequence of cycles such as wash, rinse and spin cycles. An agitator 26 is generally positioned in basket 18 to agitate or scrub the articles to be cleansed during the wash and rinse cycles, for example.

Figure 2A:
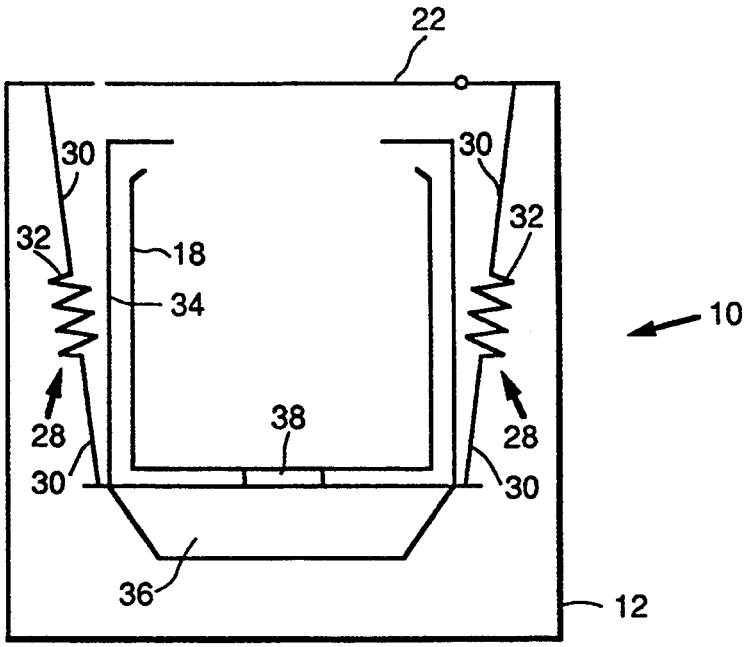
FIG. 2*a* is a simplified schematic representation illustrating an exemplary suspension for the washing machine shown in FIG. 1.

FIG. 2*a* shows a simplified schematic representation illustrating an exemplary suspension 28 used in washing machine 10 to provide mechanical isolation and support with respect to cabinet 12 of components such as washer basket 18, a tub 34, a motor 36 and a transmission 38. Suspension 28 typically comprises connecting rods 30 and springs 32 suitably selected in accordance with the particular mechanical characteristics of a given washing machine. During the wash and rinse cycles, tub 34 is filled with water and agitator 26 (not shown in FIGS. 2*a* and 2*b*) may be driven back and forth by motor 36 respectively linked to agitator 26 and basket 18 by transmission 38, for example.

Figure 2B:
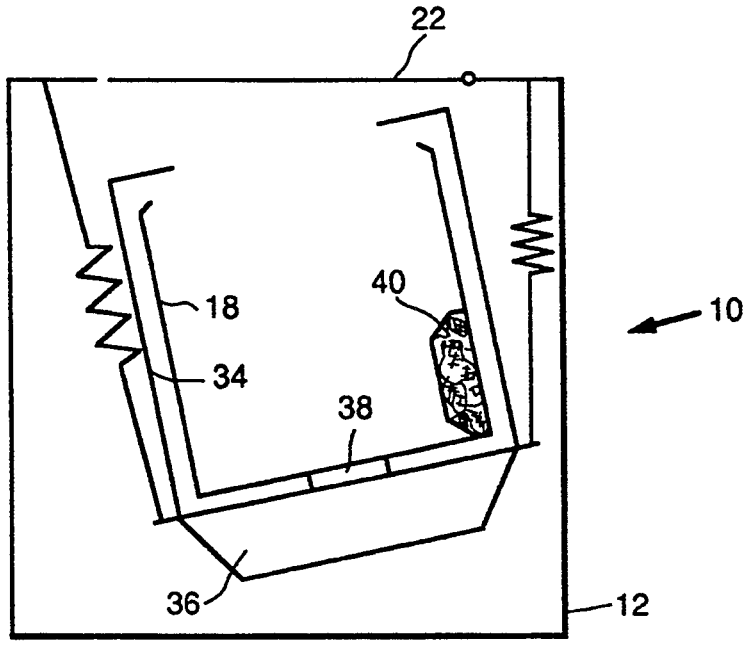
FIG. 2*b* illustrates the representation of FIG. 2*a* during an out-of-balance condition.

FIG. 2*b* illustrates a condition herein referred to as out-of-balance (OOB) condition which can arise during a spin cycle, as basket 18 is rotated about its spin axis by motor 36 at a relatively high spin speed to extract moisture from articles 40. The OOB condition for purposes of illustration can be characterized in terms of excursions of tub 34 in a direction generally perpendicular to the spin axis during the spin cycle, for example. In the case of a top-loading washing machine, such spin axis may be generally situated in a substantially vertical plane whereas in a front-loading washing machine such spin axis may be generally situated in a substantially horizontal plane. As seen in FIG. 2*b* in the context of a top-loading washing machine, articles 40 may asymmetrically bunch up at various height locations in spinning basket 18 and due to the resulting load unbalance in combination with the centrifugal force generated during the spin cycle, the tub 34 may oscillate uncontrollably so as to strike cabinet 12 as well as to impose undue stress force on various components of the washing machine such as the transmission, suspension and other such washing machine components. It should be appreciated that the foregoing OOB condition can develop regardless of the specific orientation of the spin axis of the washer basket and thus the system and method of the present invention can be effectively used in either top or front-loading washing machines.

Figure 3:
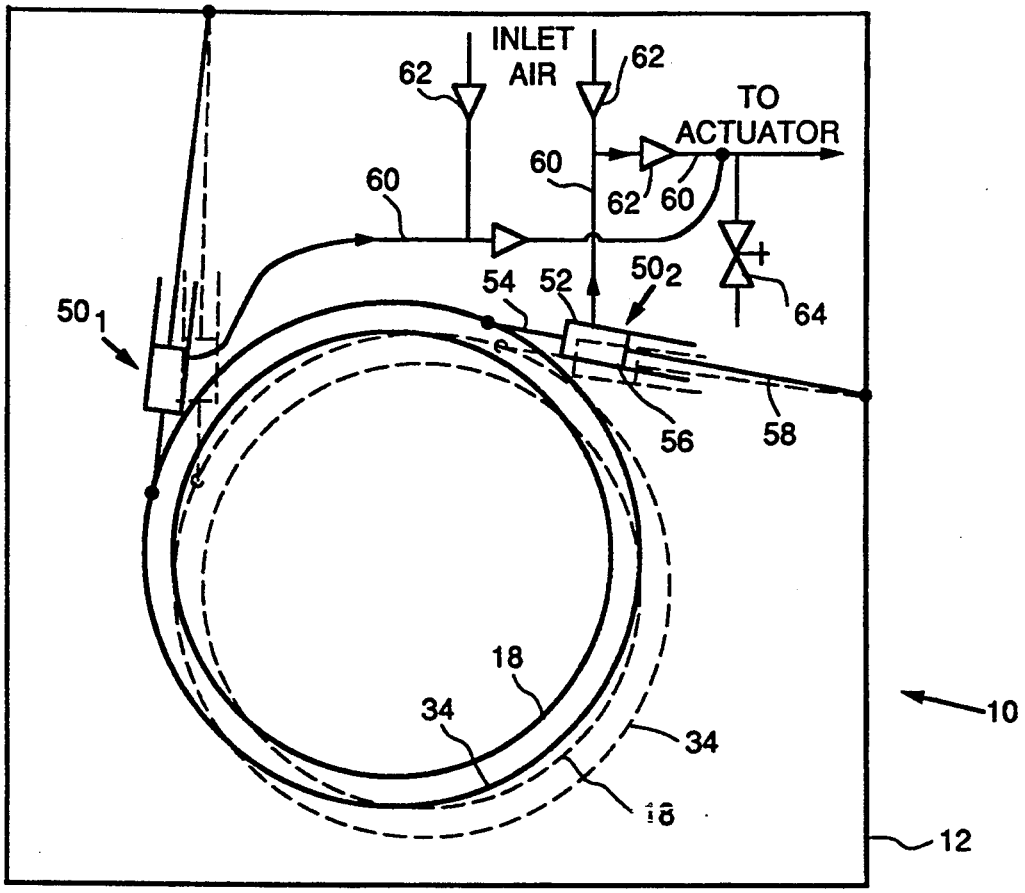
FIG. 3 illustrates a schematic plan view of a washing machine incorporating one exemplary embodiment of a system in accordance with the present invention.

FIG. 3 shows a simplified schematic plan view of a washing machine 10 which incorporates one exemplary embodiment of a system for detecting and interrupting the OOB condition in accordance with the present invention. The system comprises means for generating a fluidic pressure in response to excursions of the tub The generating means may comprise one or more respective generating units such as generating units $\mathbf{50_1}$ and $\mathbf{50_2}$. Only two such generating units are illustrated in FIG. 3 for simplicity of illustration. Preferably, the constituent fluid for developing the fluidic pressure is air, however, other gases or other suitable liquid fluid agent can be equally effective to develop such fluidic pressure. Further, those skilled in the art will appreciate that although the invention is described with reference to a positive fluidic pressure relative to atmospheric pressure, as herein used the term fluidic pressure is not limited to such positive pressure since fluidic pressures below atmospheric pressure can be used equally effectively in the implementation of the present invention.

As shown in FIG. 3, each generating unit $\mathbf{50_1}$ and $\mathbf{50_2}$ comprises a respective housing 52 having an extension 54 pivotally connected to tub 34, and a generating piston 56 having a respective extension 58 pivotally connected, by way of example and not a limitation, to cabinet 12. As represented in FIG. 3 by the dashed lines, tub excursions induced by the OOB condition causes housing 52 and generating piston 56 of a respective generating unit to reciprocate relative to one another thereby generating the predetermined fluidic pressure.

In essence, each generating unit functions as pneumatic generator having preselected parameters such as a respective time constant and pneumatic gain chosen such that each generating unit supplies its respective contribution to the overall fluidic pressure developed in response to the OOB condition. The use of pneumatics to sense the OOB condition advantageously provides a unique manner of detecting an actual OOB condition, as opposed to detecting a single excursion of the tub which, as previously explained, can cause mistaken interruption of the washing operation.

An added benefit of the generating units can be further obtained if respective pairs, such as generating units $50_1$ and $50_2$, are positioned in spaced relationship to one another oriented by way of example and not of limitation at an angle of about 90° or other suitable angle with respect to one another in a respective plane substantially perpendicular relative to the spin axis of basket 18. Depending on the specific orientation of the spin axis of the washer basket, such plane can be situated either substantially horizontal or vertical so as to maintain such substantially perpendicular relationship with respect to the spin axis of the washer basket. The 90° angle can be conveniently used in situations wherein two or four generating units form respective orthogonal pairs. In a more general case such angle is appropriately chosen such that each mutually spaced pair of generating units is positioned in substantially equiangular relationship with respect to each other. For example, in the case of three generating units a suitable angle between respective pairs would be 120° whereas in the case of five generating units a suitable angle would be 72° between respective pairs of such generating units. In each case, the added benefit is that such spatial arrangement can utilize the pneumatic forces developed in such generating units to provide substantially symmetric mechanical damping to tub 34 and hence reduce the magnitude of the excursions of tub 34 during the OOB condition or other transitory conditions as may be encountered while spinning up or down basket 18. The foregoing equiangular relationship between the generating units is only a convenient exemplary arrangement which can provide such substantially symmetric mechanical damping, however, the generating units are not limited to exhibit such geometric relationship since other arrangements may be utilized to effectively generate the predetermined fluidic pressure.

It will be understood that other design implementations will be equally effective so long as the excursions of the tub due to the OOB condition result in reciprocating action of the generating piston relative to its respective housing so as to generate the predetermined fluidic pressure within the housing. For example, piston extension 58 instead of being directly connected to cabinet 12, piston extension 58 could be conveniently supported to suspension 28 (shown in FIGS. 2*a* and 2*b*), for example. Alternatively, the respective connecting functions of housing extension 54 and piston extension 58 could be reversed, that is, generating unit 50 could be situated so that housing extension 54 is connected to cabinet 12 while piston extension is connected to tub 34.

Figure 4:
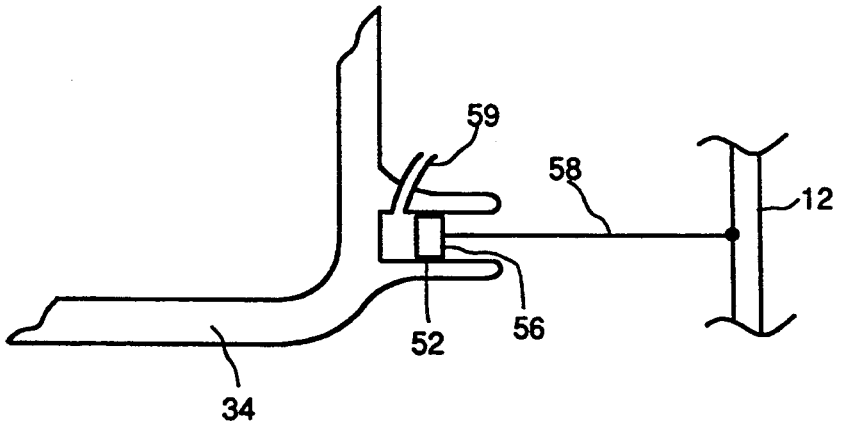
FIG. 4 illustrates a sectional elevation view of an exemplary embodiment of a generating unit integral to the tub of the washing machine and which can be used in the system of FIG. 3.

As shown in FIG. 4, housing 52 can be alternatively constructed as an integral pan of tub 34 and thus eliminate the need for housing extension 54. For example, housing 52 having a suitable outlet 59 can be molded or patterned in tub 34 and in this manner housing 52 and tub 34 can be conveniently made integral to one another so as to reduce assembly as well as manufacturing cost associated with the generating units.

Figure 5A:
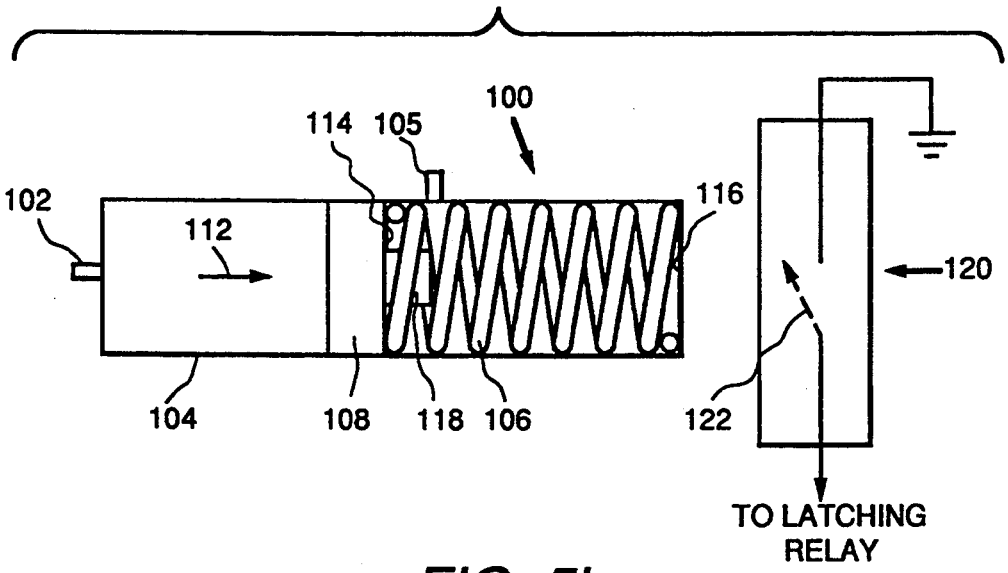
FIGS. 5*a* and 5*b* illustrate respective schematic views of an exemplary actuator in its nonactuating and actuating positions, respectively, and an exemplary switch activated therewith in accordance with the present invention.
Figure 5B:
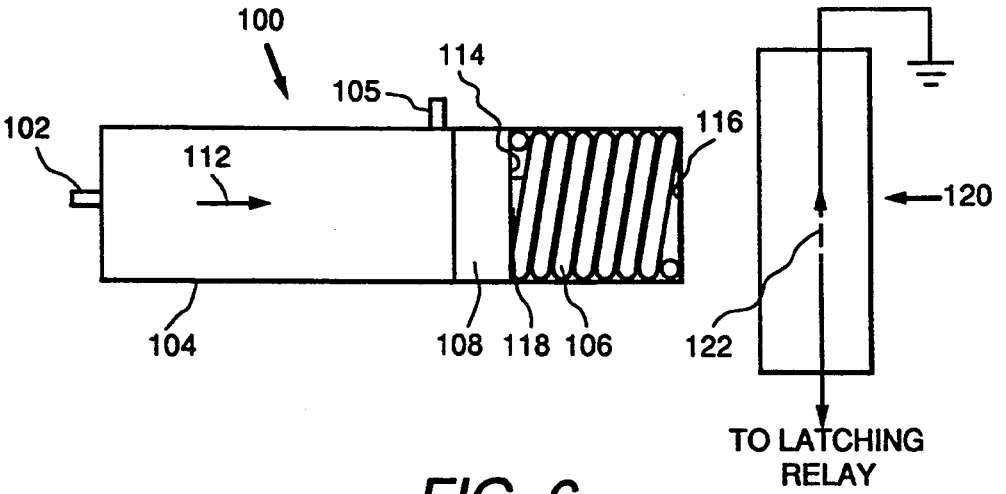

Returning to FIG. 3, a respective conduit 60 such as a hose or the like may be conveniently used to transmit the fluidic pressure from each generating unit to an actuator 100 as best shown in FIGS. 5*a* and 5*b*. To insure that the fluidic pressure increases monotonically during the OOB condition respective unidirectional pneumatic valves 62 can be installed along conduit 60. Further, a bleed valve 64 or suitable fluid escape device can be provided in conduit 60 for bleeding off the constituent fluid such as pressurized air and thus removing the fluidic pressure upon interruption of the out-of-balance condition. Bleed valve 64 also conveniently provides a way to bleed off transient fluidic pressure buildup which may occur during conditions which do not correspond to the actual OOB condition. For example, as the washer basket spins up or down, it is typical to encounter certain natural mechanical frequencies which can induce brief or momentary excursions of the tub.

FIGS. 5*a* and 5*b* schematically illustrate an actuator 100 in nonactuating and actuating positions, respectively. Actuator 100 is fluidly coupled to each generating unit $50_1$ and $50_2$ and is responsive to a a predetermined level of the fluidic pressure received through an inlet 102 in its housing 104 for providing an actuating position corresponding to the out-of-balance condition as shown in FIG. 5*b*. To prevent excessive fluidic pressure buildup within housing 104 during the OOB condition, a safety valve 105 may be provided in housing 104, for example.

Actuator 100 includes biasing means such as a spring 106 and an actuating piston 108 which cooperate so that actuating piston 108 moves in response to the predetermined level of fluidic pressure from a nonactuating position illustrated in FIG. 5*a* in the direction indicated by arrow 112 to reach the actuating position shown in FIG. 5*b* and moves back to the nonactuating position absent the predetermined level of fluidic pressure required to counteract the opposing spring force. Spring 106 can be connected between a predetermined face of the piston such as face 114 and an opposite facing end of the housing such as end 116. Actuating piston can include a magnet 118 disposed on face 114 thereof. Alternatively, piston 108 can be made up of suitable magnetic material. In each case, a switch 120 which can be magnetically actuated such as a magnetic reed switch or a Hall effect switch, for example, is responsive to actuator 100 to deenergize motor 36 (shown in FIGS. 2*a* and 2*b*) upon the actuator being in its actuating position. For instance, in the actuating position shown in FIG. 5*b* the actuating piston is sufficiently proximate to switch 120 so that the magnetic field produced by the magnet or by the magnetic material in actuating piston 108 causes switch contact 122 to reach a position which disables operation of motor 36 upon detection of the OOB condition. As disclosed in the foregoing incorporated by reference patent application Ser. No. 08/124,519 (RD-23057), other types of switches such as mechanically actuated switches can be suitably coupled to actuator 100 to disable operation of motor 36 upon detection of the OOB condition. Preferably, contact 122 is connected to a latching relay (not shown) or other suitable electronic device to prevent the washing machine from restarting when the actuating piston retracts, as air bleeds out of the housing, to its nonactuating position shown in FIG. 5*a*. In this manner, once the OOB condition has been interrupted the user can readjust the positioning of articles in the basket and restart the washing machine by depressing a suitable start button or the like.

Figure 6:
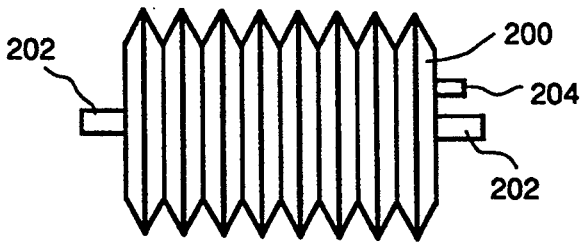
FIG. 6 illustrates a schematic representation of a bellows which can be conveniently used in another embodiment of the present invention.

FIG. 6 illustrates a schematic representation of a bellows 200 which can perform substantially the same operation as the generating units described in the context of FIG. 3. The bellows can have respective opposite extensions 202 which can be suitably connected to tub 34 and cabinet 12, respectively, so that bellows 200 produces in response to tub excursions the fluidic pressure required to operate actuator 100. In this case, a port 204 can serve as an outlet port for the fluidic pressure produced by the bellows. Additionally, actuator 100 itself could be replaced by a respective bellows which could have magnet 118 mounted at one end thereof and thus provide essentially the same actuating function as described in the context of FIGS. 5*a* and 5*b*. In this case, port 204 serves an an inlet port to the fluidic pressure produced by the generating units fluidly coupled to the bellows actuator.

It will be readily understood by those skilled in the art that the present invention is not limited to the specific embodiments described and illustrated herein. Many variations, modifications and equivalent arrangements will now be apparent by the foregoing specification and drawings, without departing from the substance or scope of the invention. Accordingly, it is intended that the invention be limited only by the spirit and scope of the appended claims.

What is claimed is:

1. A system for detecting and interrupting an out-of-balance condition in a washing machine having a tub inside a cabinet, said tub enclosing a washer basket for holding articles to be cleansed, said washing machine including means for spinning said basket about a predetermined spin axis during a spin cycle, said tub being susceptible to an out-of-balance condition characterized by excursions of said tub in a direction generally perpendicular to said spin axis during said spin cycle, said system comprising:

means connected to said tub and said cabinet for generating a fluidic pressure in response to said excursions of said tub;

actuating means fluidly coupled to said generating means and responsive to a predetermined level of said fluidic pressure for providing an actuating position corresponding to said out-of-balance condition;

a conduit for transmitting said fluidic pressure from the generating means to the actuating means;

a switch responsive to said actuating means to deenergize said spinning means upon said actuating means being in said actuating position thereby interrupting said out-of-balance condition[.]i and a bleed valve in said conduit for avoiding deenergization of the spinning means under conditions not substantially corresponding to an actual out-of-balance condition.

2. A system in accordance with claim 1 wherein a constituent fluid for said fluidic pressure is air.

3. A system in accordance with claim 2 wherein said generating means comprises a housing having an extension thereof pivotally connected to said tub, said generating means further comprising a generating piston having an extension thereof pivotally supported to said cabinet, said generating piston and said housing reciprocating relative to one another in response to said excursions of said tub and constituting one generating unit to produce said fluidic pressure.

4. A system in accordance with claim 3 wherein said generating means comprises additional generating units substantially similar to said one generating unit, said additional generating units and said one generating unit being arranged in respective mutually spaced pairs.

5. A system in accordance with claim 4 wherein each generating unit in a respective one of said pairs is oriented at a predetermined angle with respect to one another in a respective plane situated substantially perpendicular to said spin axis.

6. A system in accordance with claim 5 wherein said plane is substantially horizontal.

7. A system in accordance with claim 5 wherein said plane is substantially vertical.

8. A system in accordance with claim 5 wherein said predetermined angle is chosen to position respective ones of said mutually spaced pairs in substantially equiangular relationship with respect to one another.

9. A system in accordance with claim 2 wherein said generating means comprises a housing integral to said tub, said generating means further comprising a generating piston having an extension thereof pivotally supported to said cabinet, said generating piston and said housing reciprocating relative to one another in response to said excursions of said tub and constituting one generating unit to produce said fluidic pressure.

10. A system in accordance with claim 9 wherein said generating means comprises additional generating units substantially similar to said one generating unit, said additional generating units and said one generating unit being arranged in respective mutually spaced pairs.

11. A system in accordance with claim 10 wherein each generating unit in a respective one of said pairs is oriented at a predetermined angle with respect to one another in a respective plane situated substantially perpendicular to said spin axis.

12. A system in accordance with claim 2 wherein said generating means comprises one bellows having one extension thereof connected to said tub and said one bellows having another extension thereof supported to said cabinet.

13. A system in accordance with claim 12 wherein said generating means comprises additional bellows substantially similar to said one bellows, said one bellows and said additional bellows being arranged in respective mutually spaced pairs.

14. A system in accordance with claim 13 wherein each bellows in a respective one of said bellows pairs is oriented at a predetermined angle with respect to one another in a respective plane substantially perpendicular to said spin axis.

15. A system in accordance with claim 14 wherein said predetermined angle is chosen to position respective ones of said mutually spaced bellows pairs in substantially equiangular relationship with respect to one another.

16. A system in accordance with claim 1 wherein said actuating means comprises a respective enclosure in said cabinet, said actuating means further comprising biasing means and an actuating piston cooperating in said enclosure such that said actuating piston moves in response to said predetermined level of fluidic pressure from a nonactuating position to reach said actuating position and moves back to said nonactuating position absent said predetermined level of fluidic pressure.

17. A system in accordance with claim 16 wherein said biasing means is a spring connected between one face of said actuating piston and an opposite end of said enclosure.

18. A system in accordance with claim 17 wherein said actuating piston includes a magnet disposed in said one face of said piston.

19. A system in accordance with claim 17 wherein said actuating piston comprises magnetic material.

20. A system in accordance with claim 18 wherein said switch is a magnetically actuated switch.

21. A system in accordance with claim 19 wherein said switch is a magnetically actuated switch.

22. A washing machine comprising:

a cabinet;

a tub being inside said cabinet;

a washer basket for holding articles to be cleansed, said basket being positioned in said tub;

means for rotating said washer basket about a predetermined spin axis during a spin cycle;

said tub being susceptible to an out-of-balance condition characterized by excursions of said tube in a direction generally perpendicular to said spin axis during said spin cycle;

a system for detecting and interrupting said out-of-balance condition in said washing machine, said system comprising:

means connected to said tub and said cabinet for generating a fluidic pressure in response to said excursions of said tub;

an actuator fluidly coupled to said generating means, said actuator being responsive to a predetermined level of said fluidic pressure to provide an actuating position corresponding to said out-of-balance condition;

a conduit for transmitting said fluidic pressure from the generating means to the actuating means;

a switch responsive to said actuator to deenergize said spinning means upon said actuator being in said actuating position thereby interrupting said out-of-balance condition; and a bleed valve for avoiding deenergization of the spinning means under conditions not substantially corresponding to an actual out-of-balance condition.

23. A washing machine in accordance with claim 22 wherein a constituent fluid for said fluidic pressure is air.

24. A washing machine in accordance with claim 23 wherein said generating means comprises a housing having an extension thereof pivotally connected to said tub, said generating means further comprising a generating piston having an extension thereof pivotally supported to said cabinet, said generating piston and said housing reciprocating relative to one another in response to said excursions of said tub and constituting one generating unit to produce said fluidic pressure.

25. A washing machine in accordance with claim 24 wherein said generating means comprises additional generating units substantially similar to said one generating unit, said additional generating units and said one generating unit being arranged in respective mutually spaced pairs.

26. A washing machine in accordance with claim 25 wherein each generating unit in a respective one of said pairs is oriented at a predetermined angle with respect to one another in a respective plane situated substantially perpendicular to said spin axis.

27. A washing machine in accordance with claim 26 wherein said predetermined angle is chosen to position respective ones of said mutually spaced pairs in substantially equiangular relationship with respect to one another.

28. A washing machine in accordance with claim 23 wherein said generating means comprises a housing integral to said tub, said generating means further comprising a generating piston having an extension thereof pivotally supported to said cabinet, said generating piston and said housing reciprocating relative to one another in response to said excursions of said tub and constituting one generating unit to produce said fluidic pressure.

29. A washing machine in accordance with claim 28 wherein said generating means comprises additional generating units substantially similar to said one generating unit, said additional generating units and said one generating unit being arranged in respective mutually spaced pairs.

30. A washing machine in accordance with claim 29 wherein each generating unit in a respective one of said pairs is oriented at a predetermined angle with respect to one another in a respective plane situated substantially perpendicular to said spin axis.

31. A washing machine in accordance with claim 23 wherein said generating means comprises one bellows having one extension thereof connected to said tub and said one bellows having another extension thereof supported to said cabinet.

32. A washing machine in accordance with claim 31 wherein said generating means comprises additional bellows substantially similar to said one bellows, said one bellows and said additional bellows being arranged in respective mutually spaced pairs.

33. A washing machine in accordance with claim 32 wherein each bellows in a respective one of said bellows pairs is oriented at a predetermined angle with respect to one another in a respective plane situated perpendicular to said spin axis.

34. A washing machine in accordance with claim 33 wherein said plane is substantially horizontal.

35. A washing machine in accordance with claim 33 wherein said plane is substantially vertical.

36. A washing machine in accordance with claim 33 wherein said predetermined angle is chosen to position respective ones of said mutually spaced bellows pairs in substantially equiangular relationship with respect to one another.

37. A washing machine in accordance with claim 22 wherein said actuator comprises a respective enclosure in said cabinet, said actuator further comprising biasing means and an actuating piston cooperating in said enclosure such that said actuating piston moves in response to said predetermined level of fluidic pressure from a nonactuating position to reach said actuating position and moves back to said nonactuating position absent said predetermined level of fluidic pressure.

38. A washing machine in accordance with claim 37 wherein said biasing means is a spring connected between one face of said actuating piston and an opposite end of said enclosure.

39. A washing machine in accordance with claim 38 wherein said actuating piston includes a magnet disposed in said one face of said piston.

40. A washing machine in accordance with claim 38 wherein said actuating piston comprises magnetic material.

41. A washing machine in accordance with claim 39 wherein said switch is a magnetically actuated switch.

42. A washing machine in accordance with claim 40 wherein said switch is a magnetically actuated switch.

43. A method for detecting and interrupting an out-of-balance condition in a washing machine having a tub inside a cabinet, said tub enclosing a basket for holding articles to be cleansed, said washing machine including means for spinning said basket about a predetermined spin axis during a spin cycle, said tub being susceptible to an out-of-balance condition characterized by excursions of said tub in a direction generally perpendicular to said spin axis during said spin cycle, said method comprising:

generating a fluidic pressure in response to said excursions of said tub;

operating actuating means responsive to a predetermined level of said fluidic pressure for providing an actuating position corresponding to said out-of-balance condition;

deenergizing said spinning means upon said actuating means being in said actuating position thereby interrupting said out-of-balance condition; and bleeding off a constituent fluid for the fluidic pressure to avoid deenergization of the spinning means under conditions not substantially corresponding to an actual out-of-balance condition.

44. A method for detecting and interrupting an out-of-balance condition in a washing machine having a tub inside a cabinet, said tub enclosing a basket for holding articles to be cleansed, said washing machine including means for spinning said basket about a predetermined spin axis during a spin cycle, said tub being susceptible to an out-of-balance condition characterized by excursions of said tub in a direction generally perpendicular to said spin axis during said spin cycle, said method comprising:

generating a fluidic pressure in response to said excursions of said tub;

operating an actuator responsive to a predetermined level of said fluidic pressure for providing an actuating position corresponding to said out-of-balance condition; deenergizing said spinning means upon said actuator being in said actuating position thereby interrupting said out-of-balance condition and bleeding off a constituent fluid for the fluidic pressure to avoid deenergization of the spinning means under conditions not substantially corresponding to an actual out-of-balance condition.

* * * * *